US010641261B2

(12) United States Patent
Inoue

(10) Patent No.: US 10,641,261 B2
(45) Date of Patent: May 5, 2020

(54) PUMP WITH MOTOR

(71) Applicant: OKENSEIKO Co., Ltd., Tokyo (JP)

(72) Inventor: Akira Inoue, Tokyo (JP)

(73) Assignee: OKENSEIKO CO., LTD., Tokyo (JP)

( * ) Notice: Subject to any disclaimer, the term of this patent is extended or adjusted under 35 U.S.C. 154(b) by 345 days.

(21) Appl. No.: 15/887,933

(22) Filed: Feb. 2, 2018

(65) Prior Publication Data

US 2018/0223824 A1 Aug. 9, 2018

(30) Foreign Application Priority Data

Feb. 3, 2017 (JP) ..... 2017-018442

(51) Int. Cl.
*F04B 39/12* (2006.01)
*F04B 17/03* (2006.01)
(Continued)

(52) U.S. Cl.
CPC ..... *F04B 39/121* (2013.01); *F04B 1/145* (2013.01); *F04B 17/03* (2013.01); *F04B 39/14* (2013.01);
(Continued)

(58) Field of Classification Search
CPC ..... F04B 39/121; F04B 39/14; F04B 17/03; F04B 53/16; F04B 53/22; F04B 43/04;
(Continued)

(56) References Cited

U.S. PATENT DOCUMENTS 5,620,311 A * 4/1997 Wetzel ..... B60T 8/4022 417/415
5,895,207 A * 4/1999 Burgdorf ..... B60T 8/368 417/410.1
(Continued)

FOREIGN PATENT DOCUMENTS

CN 101384459 A 3/2009
CN 207879571 U 9/2018
(Continued)

OTHER PUBLICATIONS

European Search Report and Written Opinion received for EP Patent Application No. 18154576.5, dated Jun. 13, 2018, 7 pages.
(Continued)

*Primary Examiner* — Christopher S Bobish
(74) *Attorney, Agent, or Firm* — Womble Bond Dickinson (US) LLP

(57) ABSTRACT

A pump with a motor includes a pump housing, a motor housing, and a connecting structure configured to connect the motor housing to the pump housing. The connecting structure includes a motor connecting portion provided at an end of the pump housing, and a pump connecting portion provided at an end of the motor housing. The motor connecting portion includes a bearing configured to rotatably support the other end of the rotating shaft whose one end supported by the motor housing, a plurality of through holes, and projections projecting to the side of the motor housing. The pump connecting portion includes a first hole in which the bearing is fitted, a plurality of connecting pieces inserted
(Continued)

into the plurality of through holes, respectively, and caulked on the motor connecting portion, and second holes in which the projections are fitted.

6 Claims, 3 Drawing Sheets

(51) Int. Cl.

| | |
|---|---|
| ***F04B 53/16*** | (2006.01) |
| ***F04B 43/04*** | (2006.01) |
| ***F04B 39/14*** | (2006.01) |
| ***F04B 53/22*** | (2006.01) |
| ***F04B 43/02*** | (2006.01) |
| ***F04B 1/145*** | (2020.01) |
| ***F04B 45/04*** | (2006.01) |
| ***F04B 45/047*** | (2006.01) |

(52) U.S. Cl.
CPC ..... *F04B 43/025* (2013.01); *F04B 43/04* (2013.01); *F04B 45/043* (2013.01); *F04B 45/047* (2013.01); *F04B 53/16* (2013.01); *F04B 53/22* (2013.01); *F05B 2230/60* (2013.01)

(58) Field of Classification Search
CPC .... F04B 43/025; F04B 45/043; F04B 45/047; F04B 1/145; F05B 2230/60
See application file for complete search history.

(56) References Cited

U.S. PATENT DOCUMENTS

| | | | | |
|---|---|---|---|---|
| 6,420,811 | B1 * | 7/2002 | Wetzel | B60T 8/4022 29/596 |
| 6,623,245 | B2 * | 9/2003 | Meza | F04B 43/0054 417/423.14 |
| 7,168,929 | B2 * | 1/2007 | Siegel | B60T 8/4022 417/273 |
| 7,819,636 | B2 * | 10/2010 | Huang | F04B 45/022 417/269 |
| 8,585,372 | B2 * | 11/2013 | Bacher | B60T 17/008 181/231 |
| 9,217,425 | B2 * | 12/2015 | Looi | F04B 9/045 |
| 9,470,219 | B2 * | 10/2016 | Kato | F04D 13/06 |
| 2005/0047940 | A1 * | 3/2005 | Nawa | A61B 5/02141 417/413.1 |
| 2005/0196302 | A1 * | 9/2005 | Huang | F04B 43/026 417/412 |
| 2006/0056995 | A1 | 3/2006 | Dinkel et al. | |
| 2018/0010587 | A1 * | 1/2018 | Douglas | F04B 43/021 |

FOREIGN PATENT DOCUMENTS

| | | | |
|---|---|---|---|
| DE | 102012207236 | A1 | 3/2013 |
| JP | 57-171192 | U | 10/1982 |
| JP | H06-057063 | U | 8/1994 |

OTHER PUBLICATIONS

Office Action received for Chinese Patent Application No. 201810107466.X, dated Jan. 4, 2019, 10 pages (5 pages of English Translation and 5 pages of Office Action).

* cited by examiner

PUMP WITH MOTOR

BACKGROUND OF THE INVENTION

The present invention relates to a pump with a motor in which a pump housing and a motor housing are connected by caulking.

As a connecting structure capable of easily attaching a motor to a driven-side device such as a small pump, there is a connecting structure using "caulking" as disclosed in Japanese Utility Model Laid-Open No. 6-57063 (literature 1). The connecting structure disclosed in literature 1 is formed from a plurality of connecting pieces projecting from a motor housing and a plurality of through holes formed in the attached body of the driven-side device.

The motor housing is formed into a cylindrical shape with a closed bottom having a bottom portion to be attached to the driven-side device. A bearing storage portion formed from a cylindrical body is provided by drawing at the central portion of the bottom portion of the motor housing. The bearing storage portion is configured to store a bearing that rotatably supports the rotating shaft of the motor. The connecting pieces are formed by press working by cutting and raising portions of the bottom portion located outside the bearing storage portion in the radial direction. In addition, the connecting pieces are provided at positions that divide the bottom portion into two equal parts in the circumferential direction.

The attached body of the driven-side device is formed into a cylindrical shape with a closed bottom having a bottom portion overlaid on the bottom portion of the motor housing. A center hole in which the above-described bearing storage portion is inserted and a plurality of through holes in which the connecting pieces are inserted are formed in the bottom portion of the attached body.

To attach the attached body to the motor housing, first, the connecting pieces of the motor housing are inserted into the through holes of the attached body. Then, the bearing storage portion of the motor housing is inserted into the center hole of the attached body, and the bottom portion of the motor housing and the bottom portion of the attached body are overlaid on each other. After that, the distal ends of the connecting pieces are bent and caulked, thereby fixing the attached body to the motor housing.

The connecting structure disclosed in literature 1 has two problems to be described later. As the first problem, the reaction in the rotation direction, which acts in the motor housing, is received by only the connecting pieces. For this reason, the connecting pieces need to be firmly formed, and the workability in caulking the connecting pieces becomes low.

As the second problem, the manufacturing cost of the motor housing becomes high. This is because two types of compression molding need to be performed for the motor housing. The two types of compression molding are press working to cut and raise the connecting pieces and drawing to mold the bearing storage portion.

SUMMARY OF THE INVENTION

The present invention has been made to solve the above-described problems, and has as its object to provide a pump with a motor capable of facilitating caulking of a connecting piece and reducing the cost of a motor housing.

In order to achieve the above object, according to the present invention, there is provided a pump with a motor, comprising a pump housing made of a plastic material, a motor housing including at least a portion made of a metal material and configured to store a stator and a rotor and rotatably support one end of a rotating shaft of the rotor, and a connecting structure configured to connect the motor housing to the pump housing, wherein the connecting structure includes a motor connecting portion provided at an end of the pump housing, and a pump connecting portion provided at an end of the motor housing, the motor connecting portion includes a bearing configured to rotatably support the other end of the rotating shaft, a plurality of through holes extending in an axial direction of the rotating shaft, and projections projecting to a side of the motor housing in parallel to an axis of the rotating shaft, and the pump connecting portion includes a first hole in which the bearing is fitted, a plurality of connecting pieces inserted into the plurality of through holes, respectively, and caulked on the motor connecting portion, and second holes in which the projections are fitted.

DESCRIPTION OF THE PREFERRED EMBODIMENT

A pump with a motor according to an embodiment of the present invention will now be described in detail with reference to FIGS. 1 to 3.

Figure 1:
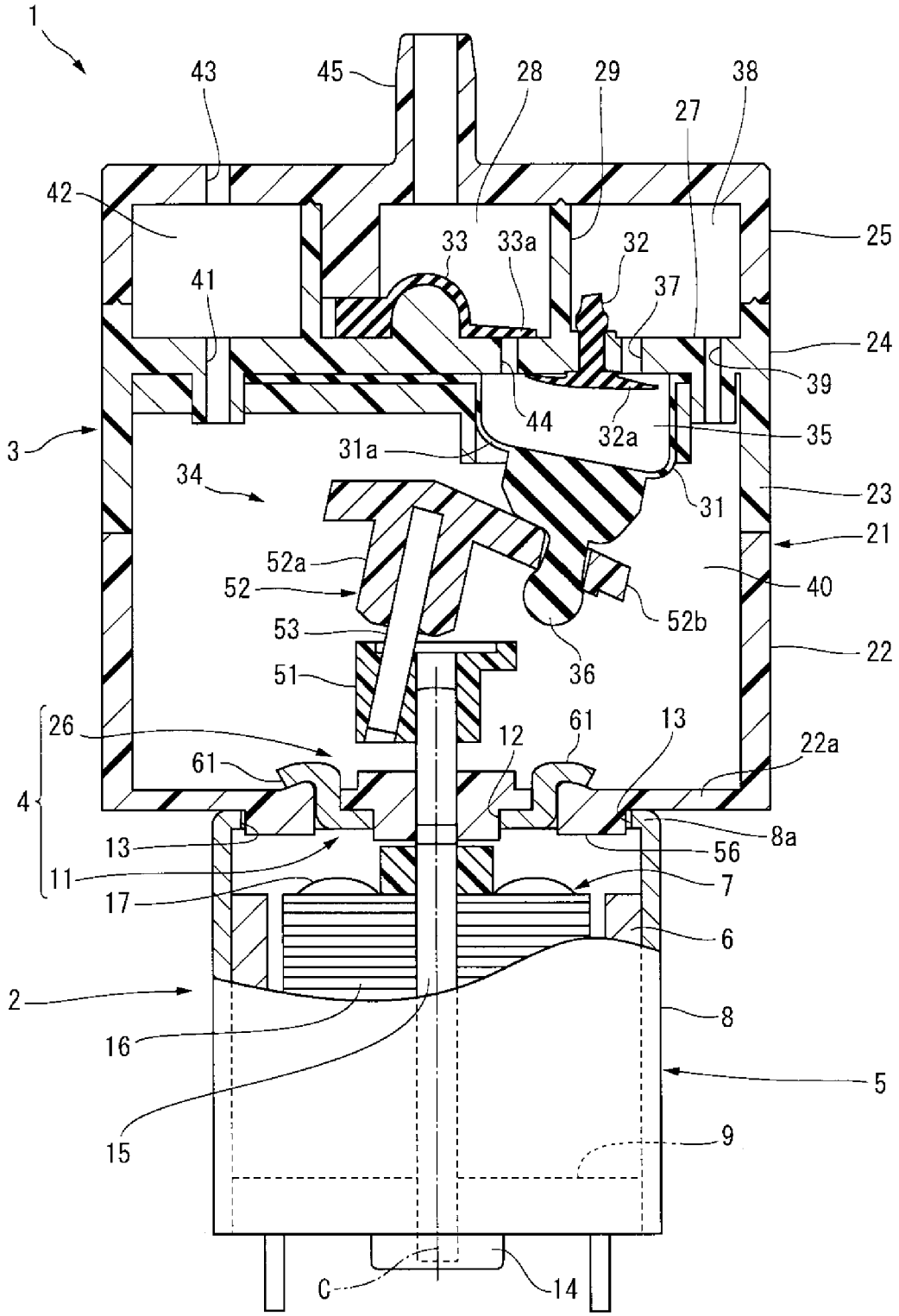
FIG. 1 is a sectional view of a pump with a motor according to an embodiment of the present invention.

A pump 1 with a motor shown in FIG. 1 includes a motor unit 2 located at the lowermost position in FIG. 1, a pump unit 3 located above the motor unit 2 in FIG. 1, and a connecting structure 4 that connects the pump unit 3 to the motor unit 2.

The motor unit 2 has a structure in which a stator 6 and a rotor 7 are stored in a motor housing 5. The motor housing 5 is formed from a main body 8 made of a metal material and having a cylindrical shape with a closed bottom, and a lid member 9 that closes the opening portion of the main body 8. The lid member 9 is made of a metal material or a plastic material. That is, at least a portion of the motor housing 5 is made of a metal material.

A bottom portion 8*a* of the main body 8 forms the bottom of the motor housing 5. A first hole 12 is formed at the axial center portion of the bottom portion 8*a*. The opening shape of the first hole 12 is circular. A plurality of second holes 13 to be described later are formed in the outer peripheral portion of the bottom portion 8*a*. The lid member 9 is formed into a disc shape. A bearing 14 for the rotor 7 is provided at the axial center portion of the lid member 9.

The stator 6 is formed into a cylindrical shape and fixed to the inner peripheral portion of the main body 8. The rotor 7 includes a rotating shaft 15 extending in the vertical direction in FIG. 1, a rotor core 16 fixed to the rotating shaft 15, a coil 17 provided on the rotor core 16, and the like. An axis C of the rotating shaft 15 is located on the same axis as the motor housing 5. One end (the end on the lower side in FIG. 1) of the rotating shaft 15 is rotatably supported by the bearing 14 of the lid member 9. That is, one end of the rotating shaft 15 is rotatably supported by the motor housing 5. The other end of the rotating shaft 15 is inserted from the motor housing 5 into the pump unit 3 through the first hole 12 and rotatably supported by a pump housing 21 to be described later.

The pump unit 3 is a diaphragm pump that is driven by the above-described motor unit 2 and thus sucks and discharges air. The pump unit 3 is formed from the pump housing 21 connected to the motor unit 2 via the connecting structure 4, and a plurality of pump components stored in the pump housing 21. Although not illustrated, the pump unit 3 is supported by a pneumatic device via a bracket connected to the pump housing 21.

The pump housing 21 is formed into a columnar shape by combining a plurality of members in the axial direction of the rotating shaft 15 of the motor unit 2, and located on the same axis as the rotating shaft 15. The plurality of members that constitute the pump housing 21 are a bottom body 22 having a cylindrical shape with a closed bottom attached to the motor housing 5, a valve holder 24 having a cylindrical portion 23 whose one end is attached to the opening portion of the bottom body 22, a lid body 25 having a cylindrical shape with a closed bottom attached to the other end of the cylindrical portion 23, and the like. The bottom body 22, the valve holder 24, and the lid body 25 are made of a plastic material. That is, the pump housing 21 is made of the plastic material.

A bottom portion 22*a* of the bottom body 22 forms the bottom of the pump housing 21 and is overlaid on the bottom portion 8*a* of the main body 8 of the motor housing 5. The valve holder 24 includes a disc portion 27 that partitions the interior of the cylindrical portion 23 into one side and the other side in the axial direction. A cylinder 29 that forms a discharge chamber 28 between it and the lid body 25 is provided at the center of the disc portion 27.

The pump components of the diaphragm pump are a diaphragm 31 held by the disc portion 27 of the valve holder 24, an inlet valve 32 and a discharge valve 33, a driving mechanism 34 connected to a deformed portion 31*a* of the diaphragm 31, and the like.

The diaphragm 31 is made of rubber and includes a plurality of cut-shaped deformed portions 31*a* that open to the disc portion 27 of the valve holder 24. FIG. 1 shows only one deformed portion 31*a*. A pump chamber 35 is formed between the deformed portion 31*a* and the disc portion 27. The deformed portion 31*a* includes a connecting piece 36 used to connect the driving mechanism 34. The connecting piece 36 is formed into a shape projecting toward the motor unit 2.

The inlet valve 32 is made of rubber and includes a disc-shaped valve body 32*a* that is in tight contact with the disc portion 27 in the pump chamber 35. The valve body 32*a* opens when the capacity of the pump chamber 35 increases, and the air is sucked from a suction through hole 37 of the disc portion 27. Otherwise, the valve body 32*a* closes by the spring force of its own. The suction through hole 37 communicates with the air via a downstream-side air chamber 38 in the lid body 25, a downstream-side path hole 39 of the disc portion 27, a housing space 40, an upstream-side path hole 41 of the disc portion 27, an upstream-side air chamber 42, and a through hole 43 of the lid body 25.

The discharge valve 33 is made of rubber and includes a plate-shaped valve body 33*a* that is in tight contact with the disc portion 27 in the discharge chamber 28. The valve body 33*a* opens when the capacity of the pump chamber 35 decreases, and the air in the pump chamber 35 is discharged from a discharge through hole 44 of the disc portion 27. Otherwise, the valve body 33*a* closes by the spring force of its own. The discharge through hole 44 communicates with the air via the discharge chamber 28 and the hollow portion of a discharge pipe 45 of the lid body 25, The driving mechanism 34 converts the rotation of the rotating shaft 15 of the motor unit 2 into a reciprocal motion and transmits it to the deformed portions 31*a* of the diaphragm 31. The driving mechanism 34 includes a crank 51 attached to the rotating shaft 15, and a driving element 52 attached to the crank 51. The driving element 52 is formed from a columnar shaft portion 52*a* rotatably supported by the crank 51 via a support shaft 53, and a plurality of arm portions 52*b* projecting outward from the shaft portion 52*a* in the radial direction. In FIG. 1, only one arm portion 52*b* is illustrated.

The support shaft 53 is connected to a portion of the crank 51 eccentric from the rotating shaft 15, and tilts with respect to the rotating shaft 15. The tilting direction of the support shaft 53 is the direction in which the distal end of the support shaft 53 is located on the same axis as the rotating shaft 15.

The connecting piece 36 of the diaphragm 31 engages with the arm portion 52*b* in a through state, and the deformed portion 31*a* is connected to the arm portion 52*b* via the connecting piece 36. For this reason, the rotation of the driving element 52 is regulated by the diaphragm 31. When the crank 51 rotates together with the rotating shaft 15, the rotation is converted into a reciprocal motion and transmitted to the deformed portion 31*a*. When the arm portion 52*b* of the driving element 52 makes a reciprocal motion, the capacity in the deformed portion 31*a* increases/decreases.

In the diaphragm pump, when the rotating shaft 15 rotates, the arm portion 52*b* repetitively reciprocally moves, and a state in which the air is sucked into the pump chamber 35 and a state in which the air is discharged from the pump chamber 35 are alternately repeated. For this reason, according to this diaphragm pump, the air is sucked from the through hole 43 of the lid body 25 into the pump housing 21, and this air is compressed by the diaphragm 31 and discharged from the discharge pipe 45 of the lid body 25.

Figure 2:
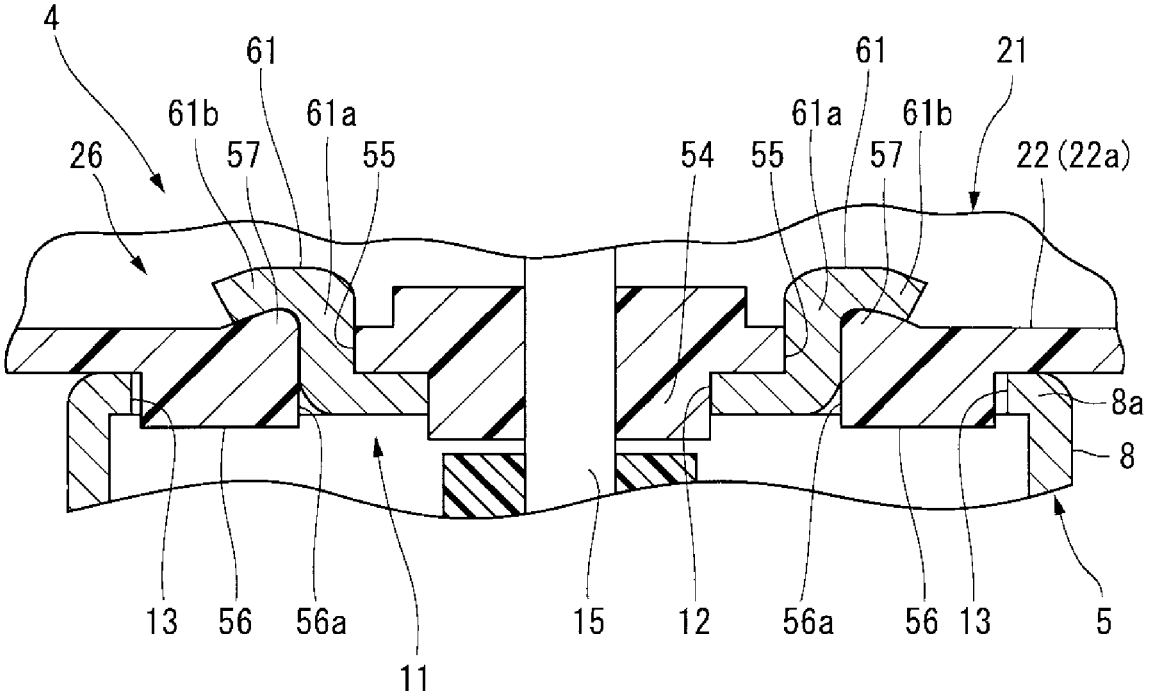
FIG. 2 is an enlarged sectional view of a main part of the pump with a motor shown in FIG. 1.

As shown in FIG. 2, the connecting structure 4 that connects the motor housing 5 and the pump housing 21 is formed from a motor connecting portion 26 provided in the bottom portion 22*a* (an end on the side of the motor unit 2) of the bottom body 22 of the pump housing 21, and a pump connecting portion 11 provided in the bottom portion 8*a* (an end on the side of the pump unit 3) of the main body 8 of the motor housing 5.

The motor connecting portion 26 includes a bearing 54 that rotatably supports the other end (an end on the side of the pump unit 3) of the rotating shaft 15, a plurality of through holes 55 extending in the axial direction of the rotating shaft 15, and a plurality of projections 56 projecting to the side of the motor housing 5 in parallel to the axis C of the rotating shaft 15. The bearing 54, the plurality of through holes 55, and the plurality of projections 56 are provided in the bottom portion 22*a* of the bottom body 22 of the pump housing 21.

The plurality of through holes 55 are formed outside the bearing 54 in the radial direction of the rotating shaft 15. In FIG. 2, the through holes 55 are illustrated at two points on both sides of the rotating shaft 15. However, the positions to provide the through holes 55 are not limited to the two points and may be positions to divide the pump housing 21 into three or four equal parts in the circumferential direction. A convex portion 57 projecting to the opposite side of the motor unit 2 is provided at the opening edge of each through hole 55 located in the pump housing 21, which is a portion located outside in the radial direction of the rotating shaft 15.

The plurality of projections 56 are formed outside the plurality of through holes 55 in the radial direction of the rotating shaft 15 at positions adjacent to the plurality of through holes 55. One side surface 56*a* of each projection 56, which is directed to the rotating shaft 15, forms a portion of the wall surface of a corresponding one of the through holes 55. That is, the through holes 55 are respectively arranged to be adjacent to the projections 56 in the radial direction of the rotating shaft 15 and provided between the bearing 54 and the projections 56 in a state in which the one side surface 56*a* of each projection 56 serves as a portion of the wall surface of a corresponding one of the through holes 55.

In FIG. 2, the projections 56 are illustrated at two points on both sides of the rotating shaft 15. However, the number of projections 56 is not limited to two. The projection 56 can be provided at one point in the circumferential direction of the pump housing 21 or provide at each of positions to divide the pump housing 21 into three or four equal parts in the circumferential direction. In case one projection 56 is provided, only one second hole 13 can be provided. In this case, a first through hole 55 of the through holes 55 is arranged to be adjacent to the projection 56 in the radial direction of the rotating shaft 15 and provided between the bearing 54 and the projection 56 in a state in which the one side surface 56*a* of the projection 56 serves as a portion of the wall surface of the first through hole 55.

The pump connecting portion 11 includes the first hole 12 in which the above-described bearing 54 is fitted, a plurality of connecting pieces 61 inserted into the plurality of through holes 55 described above and caulked in the motor connecting portion 26, and the second holes 13 in which the above-described projections 56 are fitted. The first hole 12, the plurality of connecting pieces 61, and the second holes 13 are provided in the bottom portion 8*a* of the main body 8 of the motor housing 5.

Each connecting piece 61 includes an insertion portion 61*a* extending in the axial direction of the rotating shaft 15 and inserted into the through hole 55, and a lock portion 61*b* extending from the distal end of the insertion portion 61*a* in the radial direction of the rotating shaft 15 and locked on the motor connecting portion 26. The connecting piece 61 is formed into a shape shown in FIG. 2 by a first step and a second step to be described later.

Figure 3:
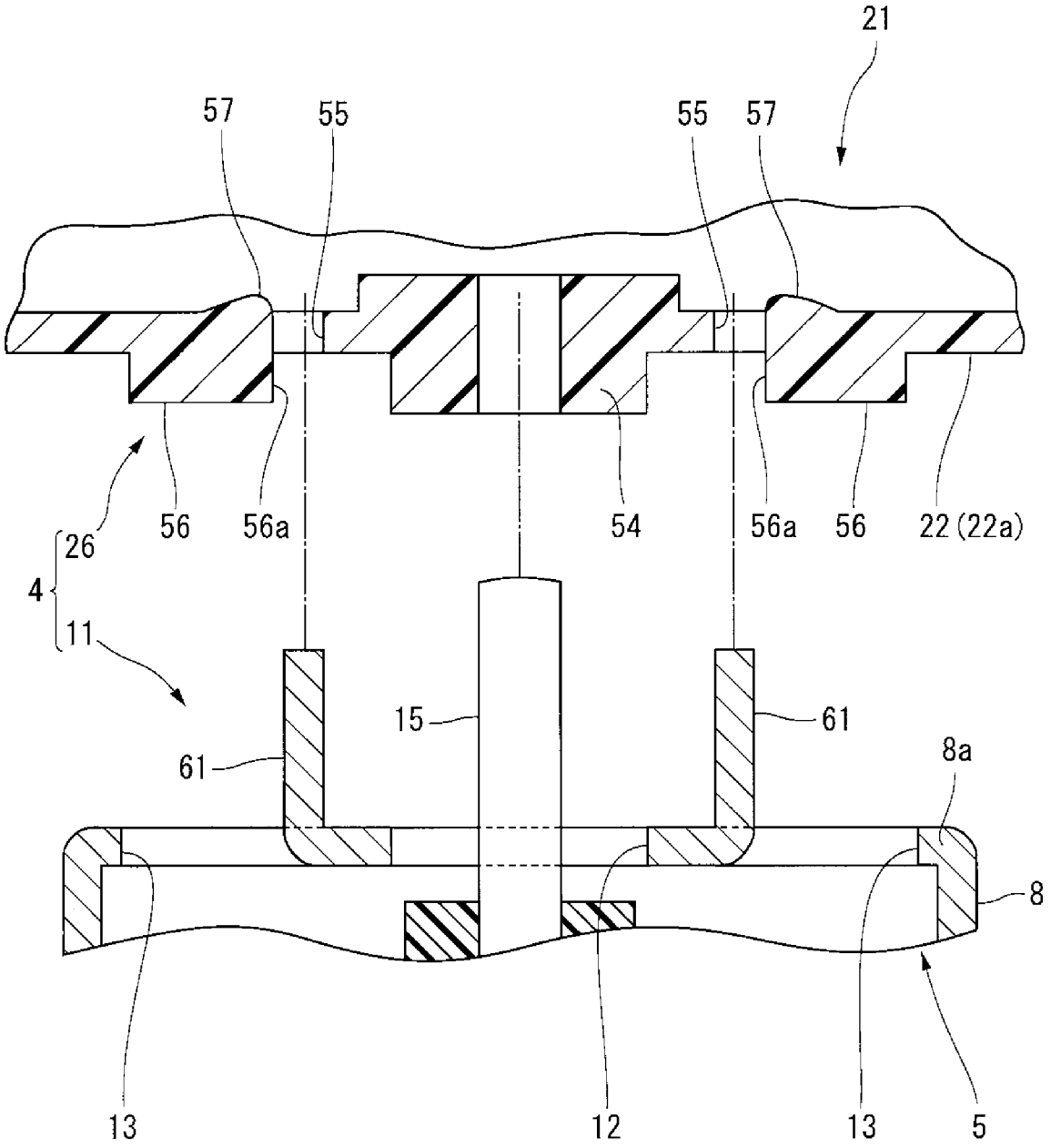
FIG. 3 is a sectional view showing a state of a portion of a motor housing and a portion of a pump housing before connection.

In the first step, as shown in FIG. 3, portions of the bottom portion 8*a* of the main body 8 are cut and raised to form the rod-shaped connecting pieces 61 projecting from the bottom portion 8*a*. The second holes 13 are holes 13 formed in the bottom portion 8*a* by cutting and raising the connecting pieces 61.

In the second step, the rod-shaped connecting pieces 61 are inserted into the through holes 55 of the pump housing 21, and caulking is performed for the distal ends of the connecting pieces 61. In the process of inserting the rod-shaped connecting pieces 61 into the through holes 55, the bearing 54 is fitted in the first hole 12 of the motor housing 5, and the projections 56 are fitted in the second holes 13. The caulking of the connecting pieces 61 is performed by bending the distal ends of the rod-shaped connecting pieces 61 outward in the radial direction of the rotating shaft 15 using a press working tool (not shown) and plastically deforming them into shapes conforming to the convex portions 57. When the distal ends of the connecting pieces 61 are caulked on the bottom body 22 of the pump housing 21 in this way, the distal ends of the connecting pieces 61 become the lock portions 61*b*, and the pump housing 21 is connected to the motor housing 5.

In FIGS. 1 to 3, the connecting pieces 61 are illustrated at two points on both sides of the rotating shaft 15. However, the positions to provide the connecting pieces 61 are not limited to the two points and may be a position on the motor housing 5 or positions to divide the motor housing 5 into three or four equal parts in the circumferential direction in correspondence with the through holes 55.

In the thus configured pump 1 with a motor, when the rotating shaft 15 of the motor unit 2 rotates, and suction and discharge of air are performed, the reaction in the rotation direction generated along with the driving is transmitted from the motor housing 5 to the pump housing 21 via the connecting structure 4. That is, the reaction in the rotation direction generated according to the rotation of the rotating shaft 15 is received by the connecting pieces 61 and the projections 56.

For this reason, as compared to a conventional connecting structure in which the reaction is received by only connecting pieces, the load on the connecting pieces 61 decreases. Hence, the connecting pieces 61 can be formed into such a size and shape that ensure a rigidity lower than in the conventional structure and facilitate caulking. In addition, since the bearing 54 is provided in the pump housing 21, compression molding portions provided in the motor housing 5 are only the press working portions to form the connecting pieces 61. Hence, according to this embodiment, the caulking of the connecting pieces 61 can easily be performed. Additionally, the compression molding portions of the motor housing 5 decrease, and the cost can be reduced.

In this embodiment, the through holes 55 of the motor connecting portion 26 are provided between the bearing 54 and the projections 56 in a state in which each through hole 55 is arranged to be adjacent to a corresponding one of the projections 56 in the radial direction of the rotating shaft 15, and the one side surface 56*a* of each projection 56 serves as a portion of the hole wall surface. For this reason, since the connecting pieces 61 and the projections 56 can be arranged in contact with each other in the radial direction of the rotating shaft 15, the connecting structure 4 can be formed compact in the radial direction of the rotating shaft 15.

In this embodiment, the connecting pieces 61 are formed by cutting and raising portions of the bottom portion 8*a* of the motor housing 5. The second holes 13 are holes 13 formed by cutting and raising the connecting pieces 61 from the motor housing 5. For this reason, since holes exclusively functioning as the second holes 13 need not be formed, the cost of the motor housing 5 can further be reduced. The connecting pieces 61 can be formed by melding a rod-shaped member, which is separately formed, to the bottom portion 8*a* of the motor housing 5.

The pump 1 with a motor according to this embodiment is a diaphragm pump. However, the type of the pump with a motor according to the present invention is not limited to a diaphragm pump, and may be another type.

What is claimed is:

1. A pump with a motor, comprising:

a pump housing made of a plastic material;

a motor housing including a portion made of a metal material and configured to store a stator and a rotor and rotatably support one end of a rotating shaft of the rotor; and a connecting structure configured to connect the motor housing to the pump housing, wherein the connecting structure includes:

a motor connecting portion provided at an end of the pump housing; and a pump connecting portion provided at an end of the motor housing, the motor connecting portion includes:

a bearing configured to rotatably support the other end of the rotating shaft;

a plurality of through holes extending in an axial direction of the rotating shaft; and a projection projecting to a side of the motor housing in parallel to an axis of the rotating shaft, and the pump connecting portion includes:

a first hole in which the bearing is fitted;

a plurality of connecting pieces inserted into the plurality of through holes, respectively, and caulked on the motor connecting portion; and a second hole in which the projection is fitted.

2. The pump according to claim 1, wherein a first through hole of the plurality of through holes is arranged to be adjacent to the projection in a radial direction of the rotating shaft and provided between the bearing and the projection in a state in which one side surface of the projection serves as a portion of a wall surface of the first through hole.

3. The pump according to claim 1, wherein the plurality of connecting pieces are formed by cutting and raising portions of the motor housing, and the second hole includes holes formed by cutting and raising the plurality of connecting pieces from the motor housing.

4. A pump with a motor, comprising:

a pump housing made of a plastic material;

a motor housing including a portion made of a metal material and configured to store a stator and a rotor and rotatably support one end of a rotating shaft of the rotor;

a bearing provided in a bottom of the pump housing and configured to rotatably support the other end of the rotating shaft;

a plurality of through holes provided in the bottom of the pump housing and extending in an axial direction of the rotating shaft;

a projection provided on the bottom of the pump housing and projecting to a side of the motor housing in parallel to an axis of the rotating shaft;

a first hole provided in a bottom of the motor housing, in which the bearing is fitted;

a plurality of connecting pieces provided on the bottom of the motor housing, inserted into the plurality of through holes, respectively, and caulked on the bottom of the pump housing; and a second hole provided in the bottom of the motor housing, in which the projection is fitted.

5. The pump according to claim 4, wherein a first through hole of the plurality of through holes is arranged to be adjacent to the projection in a radial direction of the rotating shaft and provided between the bearing and the projection in a state in which one side surface of the projection serves as a portion of a wall surface of the first through hole.

6. The pump according to claim 4, wherein the plurality of connecting pieces are formed by cutting and raising portions of the bottom of the motor housing, and the second hole includes holes formed by cutting and raising the plurality of connecting pieces from the bottom of the motor housing.

* * * * *